US005588975A

United States Patent [19]

Hammond et al.

[11] Patent Number: 5,588,975

[45] Date of Patent: Dec. 31, 1996

[54] COATED GRINDING TOOL

[75] Inventors: Mark S. Hammond, Houston, Tex.; Joseph D. Evans, Lafayette, Colo.

[73] Assignee: SI Diamond Technology, Inc., Austin, Tex.

[21] Appl. No.: 452,572

[22] Filed: May 25, 1995

[51] Int. Cl.[6] ..... B24D 5/00; B24D 3/06

[52] U.S. Cl. ..... 51/293; 51/295; 51/309; 451/540; 451/548; 451/552; 427/404; 427/580

[58] Field of Search ..... 51/293, 295, 309; 451/540, 541, 544, 548, 552, 553; 427/580, 404

[56] References Cited

U.S. PATENT DOCUMENTS

| | | | |
|---|---|---|---|
| 3,378,361 | 4/1968 | Harris et al. | 51/293 |
| 3,464,804 | 9/1969 | Kuratomi et al. . | |
| 3,645,706 | 2/1972 | Bovenkerk et al. . | |
| 3,650,714 | 3/1972 | Farkas . | |
| 3,859,057 | 1/1975 | Stoll et al. . | |
| 3,868,235 | 2/1975 | Held | 51/293 |
| 3,879,901 | 4/1975 | Caveney . | |
| 3,929,432 | 12/1975 | Caveney . | |
| 4,011,064 | 3/1977 | Lee et al. . | |
| 4,095,961 | 6/1978 | Wirth . | |
| 4,399,167 | 8/1983 | Pipkin . | |
| 4,554,201 | 11/1985 | Andreev et al. . | |
| 4,776,863 | 10/1988 | van den Berg et al. . | |
| 4,835,062 | 5/1989 | Holleck . | |
| 5,103,701 | 4/1992 | Lundin et al. . | |
| 5,127,924 | 7/1992 | Russell . | |
| 5,133,332 | 7/1992 | Tanaka et al. . | |
| 5,139,537 | 8/1992 | Julien . | |
| 5,308,367 | 5/1994 | Julien . | |
| 5,316,416 | 5/1994 | Kim . | |
| 5,366,522 | 11/1994 | Nakamura et al. . | |
| 5,392,759 | 2/1995 | Kwang . | |
| 5,395,680 | 3/1995 | Santhanam et al. . | |

OTHER PUBLICATIONS

A. Bakon and A. Szymanski, *Practical Uses of Diamond*, pp. 100–102. (No Date Avail.).

Brochure of Accurate Diamond Tool Corp, 62 Madison St., Hackensack, N.J. (No Date Available).

*Primary Examiner*—Deborah Jones

*Attorney, Agent, or Firm*—Winstead Sechrest & Minick P.C.

[57] ABSTRACT

Grinding tools are provided having a composite working surface with a metal bonding material coated with a modulated composition of transition metal compounds. Titanium nitride and zirconium nitride are suitable compounds. A manufacturing method for such grinding tools is also provided, employing cathodic arc deposition with transition metal compounds being formed from arcs of transition metal cathodes and a reactive gas.

12 Claims, 2 Drawing Sheets

COATED GRINDING TOOL

FIELD OF THE INVENTION

This invention relates to grinding tools. More particularly, a grinding wheel or other tool having a coating of modulated composition of two or more transition metal compounds is provided.

BACKGROUND OF THE INVENTION

Abrasives are used in three basic forms: loose particles, particles bonded with various agents into rigid forms, and particles deposited on flexible bases. This invention pertains to abrasive particles bonded into fixed, rigid forms.

All effective abrasives wear as they grind. The lifetime of an abrasive tool is determined by the wear or failure of the abrasive particles and by the adherence of the particles to the rigid base or core of the tool.

Rigid abrasive tools often are manufactured by applying abrasive particles mixed with a bonding agent, to form a composite material, to the cutting or grinding surface of the tool. The composite material is placed onto surfaces of various shapes, such as wheel, segmental, or stick shapes. In older abrasive tools, the bonding agent was often resinoid or ceramic, but in recent years the use of metallic bonding agents, such as electroplated nickel, cobalt, bronze or a bronze alloy, has become increasingly common. The particles are commonly cubic boron nitride, diamond or silicon carbide.

In addition to lifetime considerations, the effectiveness of grinding tools is also affected by loading-up of the grinding surface with material removed from the work piece. Therefore, a grinding surface having low coefficient of friction between the abrasive particles offers additional benefits by decreasing the amount of loading-up.

The use of a thin coating for prolonging the life of cutting surfaces of metal-working tools has been suggested. U.S. Pat. No. 5,308,367 discloses the use of a titanium nitride or titanium carbide coating over the abrasive particles of grinding tools. A physical vapor deposition process is proposed to produce cubic boron nitride tools coated with titanium nitride or other metal compound coatings of uniform composition.

There is continued need for abrading or grinding tools having metal-bonded grains or particles in which a coating is applied to increase the lifetime of the tools.

SUMMARY OF THE INVENTION

A rigid grinding tool is provided with the working surface, a composite material made from hard particles and a metallic bonding material, coated with a layer made up of a modulated composition of compounds of transition metals. Titanium nitride and zirconium nitride are suitable compounds. Alternatively, the compounds in the coating may be in discrete and very thin layers and may be selected to provide interfaces between the very thin layers which are at least partially coherent. The hard particles in the working surface of the tool may be cubic boron nitride, diamond, compacts or other hard abrasive particles.

A method for manufacturing such particles is also provided. The coating is applied in a vacuum chamber. Cathodes of transition metals are struck and a reactive gas, such as nitrogen, is admitted to the vacuum chamber under controlled conditions of pressure and temperature. The compounds form and are deposited in layers or alternating changes in relative composition of the transition metal compounds as the working surface to be coated moves so as to have one or the other transition metal compounds deposited at higher concentrations than the other. The working area of grinding tools may be attached to support members which convey the tools through regions of the vacuum chamber which have different concentrations of transition metals, they may be supported by a turntable or by any other mechanical means which causes the surface to move through regions having differing concentrations of the compounds.

DETAILED DESCRIPTION OF PREFERRED EMBODIMENT

Figure 1:
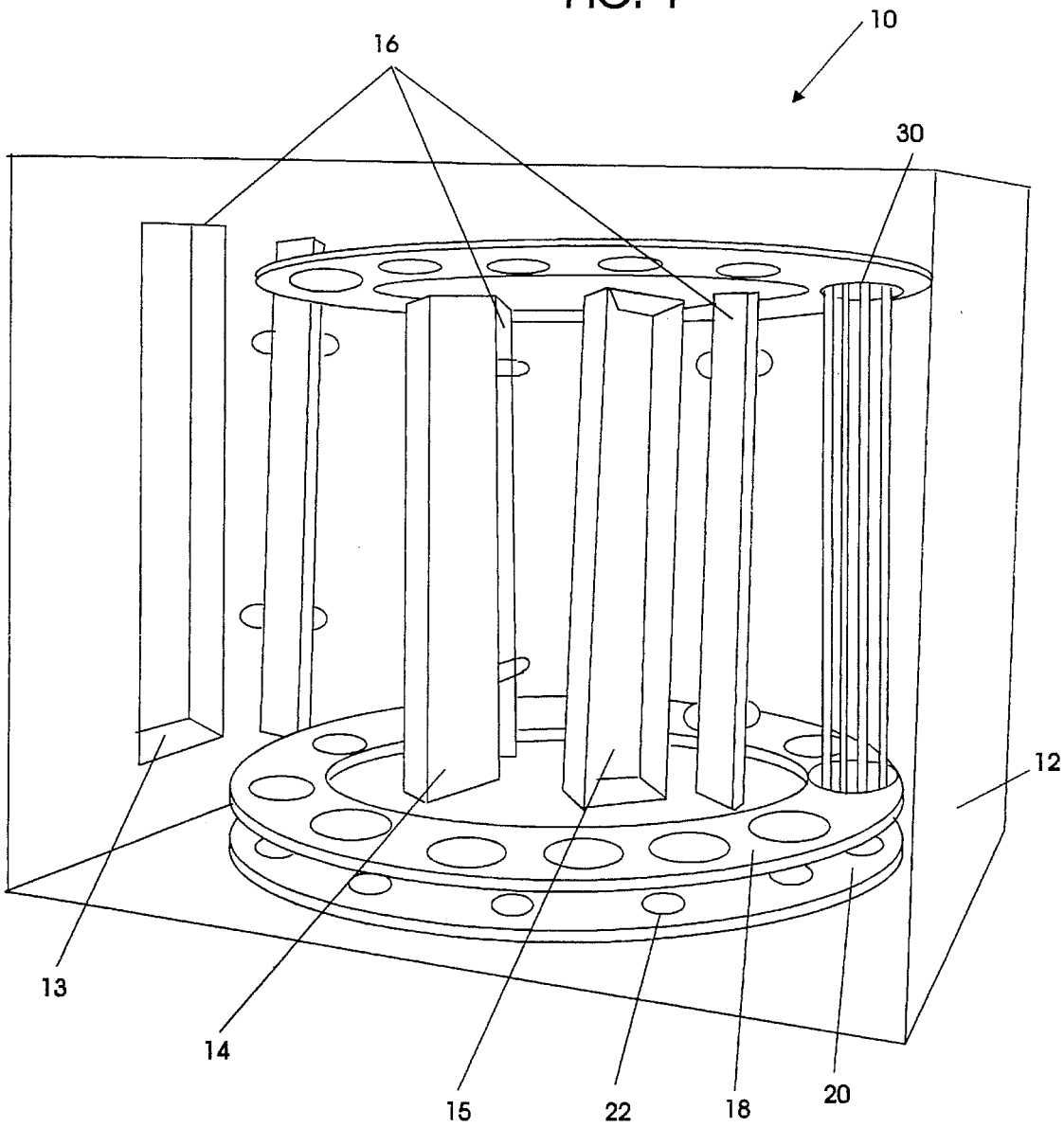
FIG. 1 is a sketch of apparatus suitable for forming the coated grinding tool of this invention.

Referring to FIG. 1, apparatus 10 suitable for forming the coated grinding tool of this invention is shown. Vacuum chamber 12 is evacuated by vacuum pumps (not shown). Access to chamber 12 may be though doors, upon which cathode assemblies such as 13 may be mounted. Cathode assembly 14 has the same metal cathode as does cathode assembly 13. Assemblies 13 and 14 are on opposite sides of the path of articles to be coated and are offset along the path of motion of the articles. A third cathode assembly 15 is directed approximately 180° from cathode assembly 14, and has a cathode of different transition metal than the metal of cathode assemblies 13 and 14. A fourth cathode assembly, having the same composition as the third assembly, is not shown in FIG. 1, for greater clarity. Turntable 20 is mounted for rotation about its axis and is driven by power from below the vacuum chamber. Electrical insulators 22 isolate carriage 18 from turntable 20, so that electrical bias voltage can be applied to carriage 18, which is electrically conducting. Sample mounting supports 30, also electrically conducting, are supported by carriage 18. Grinding tools of the present invention are affixed to supports 30 by appropriate means. Supports 30 provide planetary motion of articles as they move through the region between cathodes, two of each transition metal. Details of the apparatus are fully explained in copending application Ser. No. 08/390,542, hereby incorporated by reference herein for all purposes.

Figure 2:
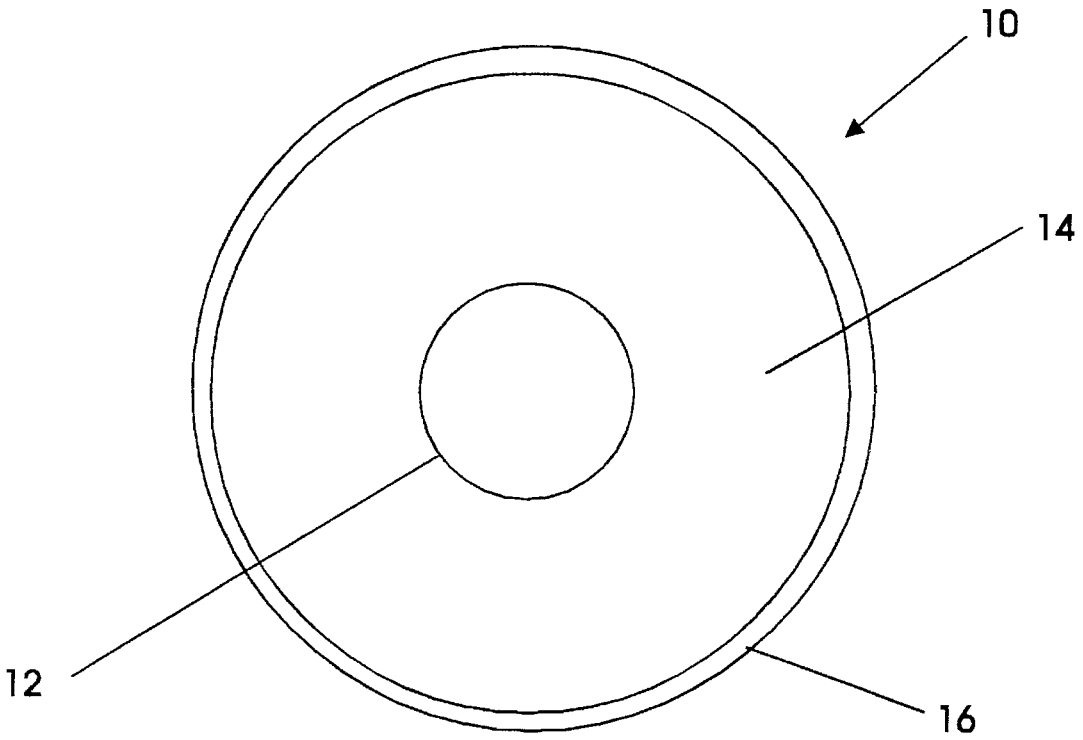
FIG. 2 is a sketch of a grinding wheel of this invention.

Referring to FIG. 2, grinding wheel 10, having hole 12 and core 14, has working surface 16. Working surface 16 is a composite material consisting of hard abrasive particles and a metal or metal alloy bonding material. Grinding wheels are available in many different shapes and sizes; wheel 10 is shown only for illustrative purposes. Composite material 16 may be placed on any surface to be used for abrading or grinding a work piece, and may be in segmented or stick shapes or any other form.

In a grinding tool of this invention, composite material 16 is coated with a modulated composition of two or more transition metal compounds. The coating is deposited by physical vapor deposition and is preferably deposited using the apparatus and method of copending application Ser. No. 08/390,542, entitled "System and Method for Depositing Coating of Modulated Composition." Alternatively, the article of this invention may have a coating deposited by any method in which the composition of the coating varies during growth of the coating. Such method is described, for example, in U.S. Pat. 4,835,062, wherein the objects to be coated are moved on a turntable beneath cathodes of different transition metals. Alternatively, the coating material of the present invention may be a material such as described in U.S. Pat. No. 4,835,062, wherein the interfaces between the phases of different composition are at least partially coherent. U.S. Pat. No. 4,835,062 is incorporated by reference herein for all purposes.

Grinding wheels of about 0.8 inch outside diameter and having cubic boron nitride particles as the abrasive and bonded with electrolytic nickel were coated with a modulated composition of titanium nitride and zirconium nitride. The tools were first cleaned, using procedures set out in the referenced co-pending patent application Ser. No. 08/390,542. After pumpdown of vacuum chamber 12 (FIG. 1) to a pressure of about $1\times10^{-6}$ torr, radiant heaters (not shown in FIG. 1) were activated and the grinding wheels were moved in planetary motion through the chamber. Temperature was raised to about 300 ° C. An argon ion etch was then used to clean the grinding wheels by increasing argon pressure in chamber 12 to about $5\times10^{-3}$ torr and increasing voltage on the tools to about negative 600–1000 volts. Then the titanium arc was struck and the tools were bombarded with argon and titanium ions to form a titanium layer about 15 nm thick to increase adhesion of a film to the tool.

After the adhesion layer was formed, the argon gas flow was augmented with about 50 percent nitrogen. The pressure was set at about $3\times10^{-3}$ torr and bias voltage on the tools was set at about 600 volts. Electrical current and rotational speed were set such that the individual layer thicknesses of titanium nitride and zirconium nitride were in the range of about 10 nm. Coating continued for 2.5 hours, until the total thickness of the coating of modulated composition was about 2.5 micrometers. Other gases which may be used to form transition metal compounds include acetylene and borane.

Grinding wheels coated as described above were tested for lifetime as a grinding tool in the manufacture of metal shafts. More than 500 uncoated wheels were tested at a spindle speed of about 35,000 RPM and found to have an average lifetime of about 200 parts. One hundred twenty coated grinding wheels were tested and found to have an average lifetime of 621 parts under the same conditions of use.

The explanation of the increased lifetime of tools of this invention is not completely clear. While not wishing to be bound by hypothesis, we hypothesize that the improvement is related to improved wear qualities of the metal bonding material resulting from the hard coating, which decreases the rate of loss of grit or particles from the wheel. Another factor may be protection against surface chemical oxidation at the high temperatures of the cutting surface. Another factor may be decrease of fracture of individual particles, resulting from the compressive stress applied by the coating at the surface of the particles. The same mechanism would be effective for cubic boron nitride, diamond or for particles of polycrystalline compacts of diamond or cubic boron nitride or other very hard abrasive materials which fail by massive fracturing of the abrasive body. The low coefficient of friction of the coating also provides for less loading-up of solids on the working surface. This will increase the abrasive effectiveness and result in less temperature rise during operation, which may also contribute to the increase in lifetime.

The invention has been described with reference to its preferred embodiments. Those of ordinary skill in the art may, upon reading this disclosure, appreciate changes or modifications which do not depart from the scope and spirit of the invention as described above or claimed hereafter.

What is claimed is:

1. A grinding tool, comprising:

a core;

a composite material on a grinding area of the core, the composite material comprising hard particles and a metal or metal alloy bonding material;

a coating on the composite material, said coating comprising a modulated composition of compounds of two or more transition metals.

2. The grinding tool of claim 1 wherein the transition metals are titanium and zirconium.

3. The grinding tool of claim 1 wherein the compounds are reaction products of a gas selected from the group of gases consisting of nitrogen, acetylene and borane and said transition metal.

4. The grinding tool of claim 1 wherein the compounds have phase interfaces which are at least partially coherent.

5. The grinding tool of claim 1 wherein the hard particles are cubic boron nitride.

6. The grinding tool of claim 1 wherein the hard particles are diamond.

7. The grinding tool of claim 1 wherein the hard particles are polycrystalline compacts of diamond or cubic boron nitride.

8. A method for manufacturing a grinding tool having a working surface comprised of a composite material, the composite material comprised of hard particles and a metal or metal alloy bonding material, said method comprising:

placing the working surface in a vacuum chamber with at least two cathodes of different transition metals;

introducing a reactive gas at a controlled pressure and concentration into the chamber; and striking arcs with the cathodes while moving said working surface and to deposit a modulated composition of reaction products of the transition metals and the reactive gas on the working surface.

9. The method of claim 8 wherein the transition metals are titanium and zirconium.

10. The method of claim 8 wherein the compounds have phase interfaces which are at least partially coherent.

11. The method of claim 8 wherein the working areas of grinding tools are attached to support members which are attached to a movable carriage, the support member being electrically isolated from the chamber, the cathodes being placed so as to form a plasma in the region along the path through which the support members pass when the carriage is moved.

12. The method of claim 8 wherein the working areas of grinding tools are placed on a turntable which is rotated so as to pass the working areas through an emission of transition metal from the arcs.

* * * * *